US007464824B2

(12) United States Patent
Utsumi

(10) Patent No.: US 7,464,824 B2
(45) Date of Patent: Dec. 16, 2008

(54) COUPLER FOR RAILWAY MODEL, AND RAILWAY MODEL VEHICLE

(75) Inventor: Shintaro Utsumi, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 190 days.

(21) Appl. No.: 11/632,190

(22) PCT Filed: Jul. 20, 2005

(86) PCT No.: PCT/JP2005/013298

§ 371 (c)(1),
(2), (4) Date: Jan. 17, 2007

(87) PCT Pub. No.: WO2006/009163

PCT Pub. Date: Jan. 26, 2006

(65) Prior Publication Data

US 2007/0251908 A1 Nov. 1, 2007

(30) Foreign Application Priority Data

Jul. 21, 2004 (JP) ..... 2004-213150

(51) Int. Cl.
*A63H 19/18* (2006.01)
*B61G 3/00* (2006.01)

(52) U.S. Cl. ..... 213/75 TC; 213/75 R

(58) Field of Classification Search ..... 213/75 R, 213/75 D, 75 TC
See application file for complete search history.

(56) References Cited

U.S. PATENT DOCUMENTS 3,330,066 A * 7/1967 Crawford ..... 446/138
3,469,713 A * 9/1969 Edwards et al. ..... 213/75 TC
3,850,310 A * 11/1974 Osthall ..... 213/75 TC
5,775,525 A * 7/1998 Brill ..... 213/75 TC
5,826,736 A * 10/1998 Weber ..... 213/75 A
6,189,713 B1 * 2/2001 Oh ..... 213/75 TC
2005/0167386 A1 * 8/2005 Barger et al. ..... 213/75 TC
2007/0251908 A1 * 11/2007 Utsumi ..... 213/75 TC

FOREIGN PATENT DOCUMENTS

| | | |
|---|---|---|
| DE | 810607 | 11/1951 |
| JP | 49-104746 | 10/1974 |
| JP | 2580083 | 11/1996 |
| JP | 2664035 | 6/1997 |

OTHER PUBLICATIONS

International Search Report mailed Sep. 27, 2005 in corresponding PCT/JP2005/013298.

* cited by examiner

*Primary Examiner*—S. Joseph Morano
*Assistant Examiner*—Jason C Smith
(74) *Attorney, Agent, or Firm*—Staas & Halsey LLP

(57) ABSTRACT

A coupler 2 for a railway model comprises a first half cylindrical section 5*e*, a second half cylindrical section 5*f* facing the first half cylindrical section 5*e* on a circle substantially concentric with the first half cylindrical section 5*e* and having an inner diameter greater than an outer diameter of the first half cylindrical section 5*e*, a first engagement section 5*g* provided in a projecting manner on an outer peripheral surface of the first half cylindrical section 5*e*, and a second engagement section 5*h* provided in a recessed manner on an inner peripheral surface of the second half cylindrical section 5*f* and having a recess width in a circumferential direction greater than a projection width in a circumferential direction of the first engagement section 5*g*.

21 Claims, 7 Drawing Sheets

COUPLER FOR RAILWAY MODEL, AND RAILWAY MODEL VEHICLE

FIELD OF THE INVENTION

The present invention relates to a coupler for a railway model and a railway model vehicle with the coupler equipped thereon.

BACKGROUND ART

For railway models, there are various standards such as N gauge, HO gauge, O gauge and the like according to the difference in spacing between right and left rails. The applicant has been selling couplers (vehicle connectors) for N gauge called TN coupler (TN coupler is a trademark of TOMY COMPANY, LTD.). Because TN coupler is different from a common Arnold coupler in that it is highly real regarding its appearance and narrowness of a space between vehicles that are coupled, and is provided with a structure to widen a space between vehicles when passing a curve, TN coupler is well-received by many users. There are TN couplers of tight coupler type for trains and tight automatic coupler type for other vehicles (diesel car, passenger car, freight car, locomotive and the like). Patent document 1 discloses the structure of the former, and Patent document 2 discloses that of the latter respectively.

Patent Document 1: JP-2580083B

Patent Document 2: JP-2664035B

DISCLOSURE OF THE INVENTION

Problems to be Solved by the Invention

However, the above described coupler for a railway model is structurally not highly capable of trajectory tracking with a twisting movement between the coupled vehicles. Therefore, in a case that one of the vehicles which are coupled falls over for some reason, the twist may be sequentially transmitted to the next vehicles through couplers, causing the whole train to fall.

The present invention has been developed in view of the above problem, and an object of the invention is to provide a new coupler for a railway model that is capable of trajectory tracking with a twist between vehicles in a flexible manner.

Means for Solving the Problem

To solve the above described problem, in accordance with a first aspect of the invention, a coupler for a railway model which conceptually contains an after-mentioned first embodiment is provided. This coupler comprises a first half cylindrical section having a substantially half cylindrical shape, a second half cylindrical section having a substantially half cylindrical shape provided to face the first half cylindrical section on a circle substantially concentric with the first half cylindrical section and having an inner diameter greater than the outer diameter of the first half cylindrical section, a first engagement section provided in a projecting manner on the outer peripheral surface of the first half cylindrical section, and a second engagement section provided in a recessed manner in the inner peripheral surface of the second half cylindrical section at a position enabling engagement with a first engagement section of a same type of a coupler to be coupled with and having a recess width in the circumferential direction greater than the width in the circumferential direction of the projection of the first engagement section.

According to a second aspect of the present invention, a coupler for a railway model which conceptually contains an after described second embodiment is provided. This coupler for railway model comprises a first half cylindrical section having a substantially half cylindrical shape, a second half cylindrical section having a substantially half cylindrical shape, provided to face the first half cylindrical section on a circle substantially concentric with the first half cylindrical section and having an inner diameter greater than the outer diameter of the first half cylindrical section, a first engagement section provided in a projecting manner on the inner peripheral surface of the second half cylindrical section, and a second engagement section provided in a recessed manner in the outer peripheral surface of the first half cylindrical section at a position enabling engagement with a first engagement section of a same type of a coupler to be coupled with and having a recess width in the circumferential direction greater than the width in the circumferential direction of the projection of the first engagement section.

The second engagement section is preferably a through hole penetrating the inner and outer surfaces of either the first half cylindrical section or the second half cylindrical section.

According to third and fourth aspects of the present invention, each half of a pair of couplers to be coupled with each other is prescribed, and an after-described third embodiment is conceptually contained therein. According to the third aspect of the present invention, a first cylindrical section having a substantially cylindrical shape, and a first engagement section provided in a recessed manner in an outer peripheral surface of the first cylindrical section at a position enabling engagement with a second engagement section provided in a projecting manner in an inner surface of a second cylindrical section, having a substantially cylindrical shape, of a different type of a coupler to be coupled with. An outer diameter of the first cylindrical section is smaller than an inner diameter of the second cylindrical section, and a projection width in a circumferential direction of the first engagement section is smaller than a recess width in the circumferential direction of the second engagement section.

According to a fourth aspect of the present invention, a coupler is provided as comprising a second cylindrical section having a substantially cylindrical shape, and a second engagement section provided in a recessed manner in an inner peripheral surface of the second cylindrical section at a position enabling engagement with a first engagement section provided in a projecting manner in an outer surface of a first cylindrical section, having a substantially cylindrical shape, on a different type of a coupler for a railway model to be coupled with. An inner diameter of the second cylindrical section is greater than an outer diameter of the first cylindrical section, and a recess width in the circumferential direction of the second engagement section is greater than a projection width in a circumferential direction of the first engagement section.

According to fifth and sixth aspects of the present invention, each half of a pair of couplers for railway models to be coupled with each other is prescribed, and an after-described fourth embodiment is conceptually contained therein. According to the fifth aspect of the present invention, a coupler is provided to comprise a first cylindrical section having a substantially cylindrical shape, and a first engagement section provided in a recessed manner in an outer peripheral surface of the first cylindrical section at a position enabling engagement with a second engagement section provided in a projecting manner in an inner peripheral surface of a second cylindrical section, having a substantially cylindrical shape, on a different type of a coupler to be coupled with. An outer diameter of the first cylindrical section is smaller than an inner diameter of the second cylindrical section, and a recess width in the circumferential direction of the first engagement section is greater than a project width in the circumferential direction of the second engagement section.

According to a sixth aspect of the present invention, a coupler for railway model is provided to comprise a second cylindrical section having a substantially cylindrical shape, and a second engagement section provided in a projecting manner in an inner peripheral surface of the second cylindrical section at a position enabling engagement with a first engagement section provided in a recessed manner in an outer peripheral surface of a first cylindrical section, having a substantially cylindrical-shape, on a different type of a coupler to be coupled with. The inner diameter of the second cylindrical section is smaller than the outer diameter of the first cylindrical section, and a projection width in the circumferential direction of the second engagement section is smaller than a recess width in the circumferential direction of the first engagement section.

Preferably, at least one of an end portion of the first cylindrical section and an end portion of the second cylindrical section has a cut portion extending inwards, to allow expansion or contraction of a diameter of a cylindrical section having the cut portion when different types of couplers are coupled together.

The second engagement section is preferably a through hole penetrating the inner and outer surfaces of either the first cylindrical section or the second cylindrical section.

According to a seventh aspect of the present invention, a railway model vehicle equipped with the above-described coupler for a railway model at an end part of the vehicle.

Effect of the Invention

According to the present invention, in a case a twist is caused between vehicles, a coupler for a railway model flexibly tracks the trajectory. Therefore, even in a case one vehicle of the coupled train falls, the transmission of the twist between the vehicles is restricted, thereby effectively preventing the entire train from falling.

BEST MODE FOR CARRYING OUT THE INVENTION

First Embodiment

Figure 1:
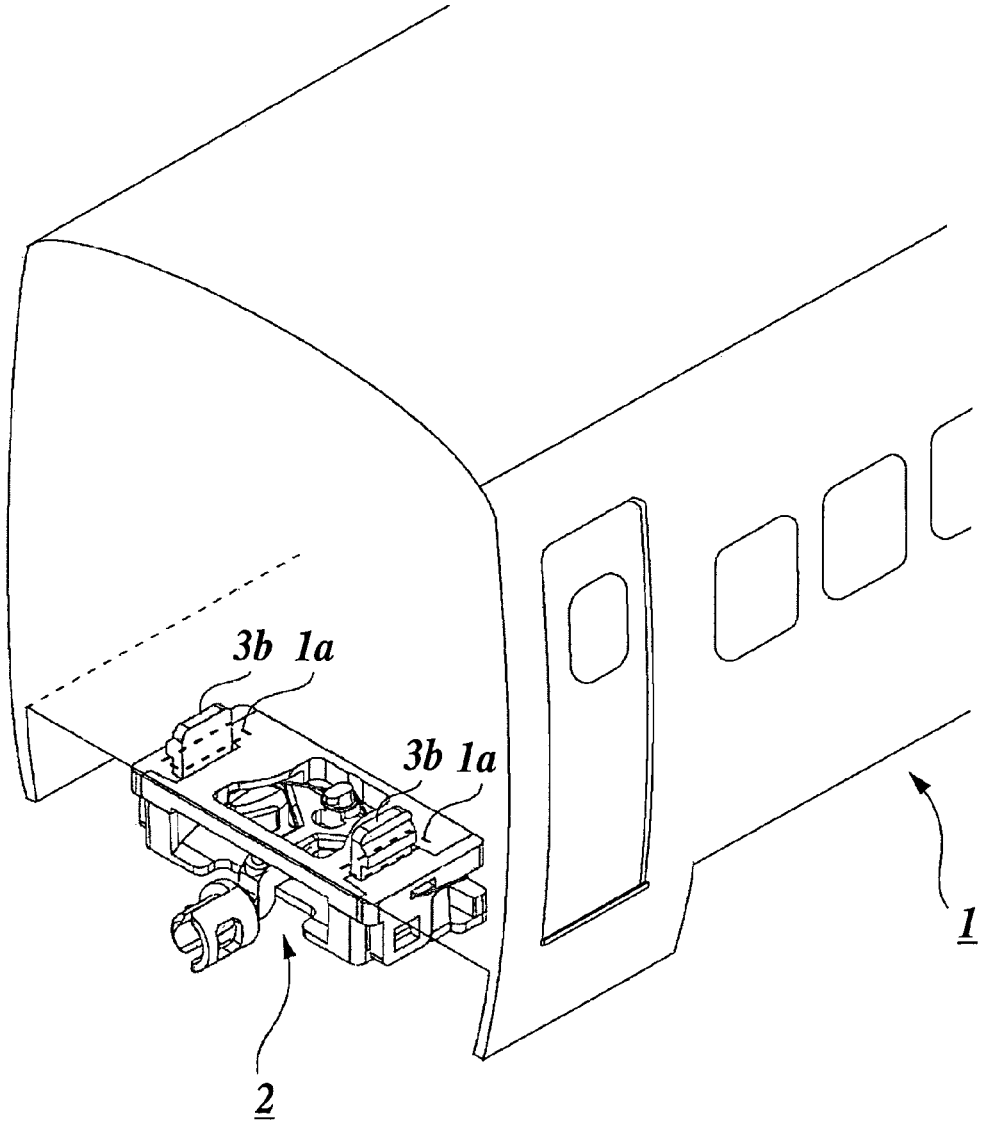
FIG. 1 is a perspective view of a vehicle with a coupler for a railway model equipped thereon.

FIG. 1 is a perspective view of a railway model vehicle equipped with a coupler for a railway model of the present embodiment. The end part of the railway model vehicle 1 is equipped with a railway model coupler 2 imitating a bar-shaped coupler called draw bar. Basically, reflecting the style of the real trains, this type of coupler 2 is envisioned to be attached to various Shinkansen bullet trains including the state-of-the-art "Series 800 Tsubame". Nonetheless, as its attachment structure itself is of the same specification with that of TN coupler, the coupler 2 is attachable to the local trains (for example, Series 165 express train which is a tight coupler type, or Series Kiha-58 rail motor which is a tight automatic coupler type, and the like) which normally do not use draw bars. As a specific example of attachment to a local train, TN coupler or dummy coupler may be used for back and front of coupled trains to maintain favorable appearance, while the coupler 2 which is excellent in coupling performance may be used for the middle part where vehicles are actually coupled. Although the present embodiment relates to N gauge which is of small scale and is especially strictly restricted on structure and cost, the present invention is applicable to cases of a larger scale in the same manner.

Figure 2:
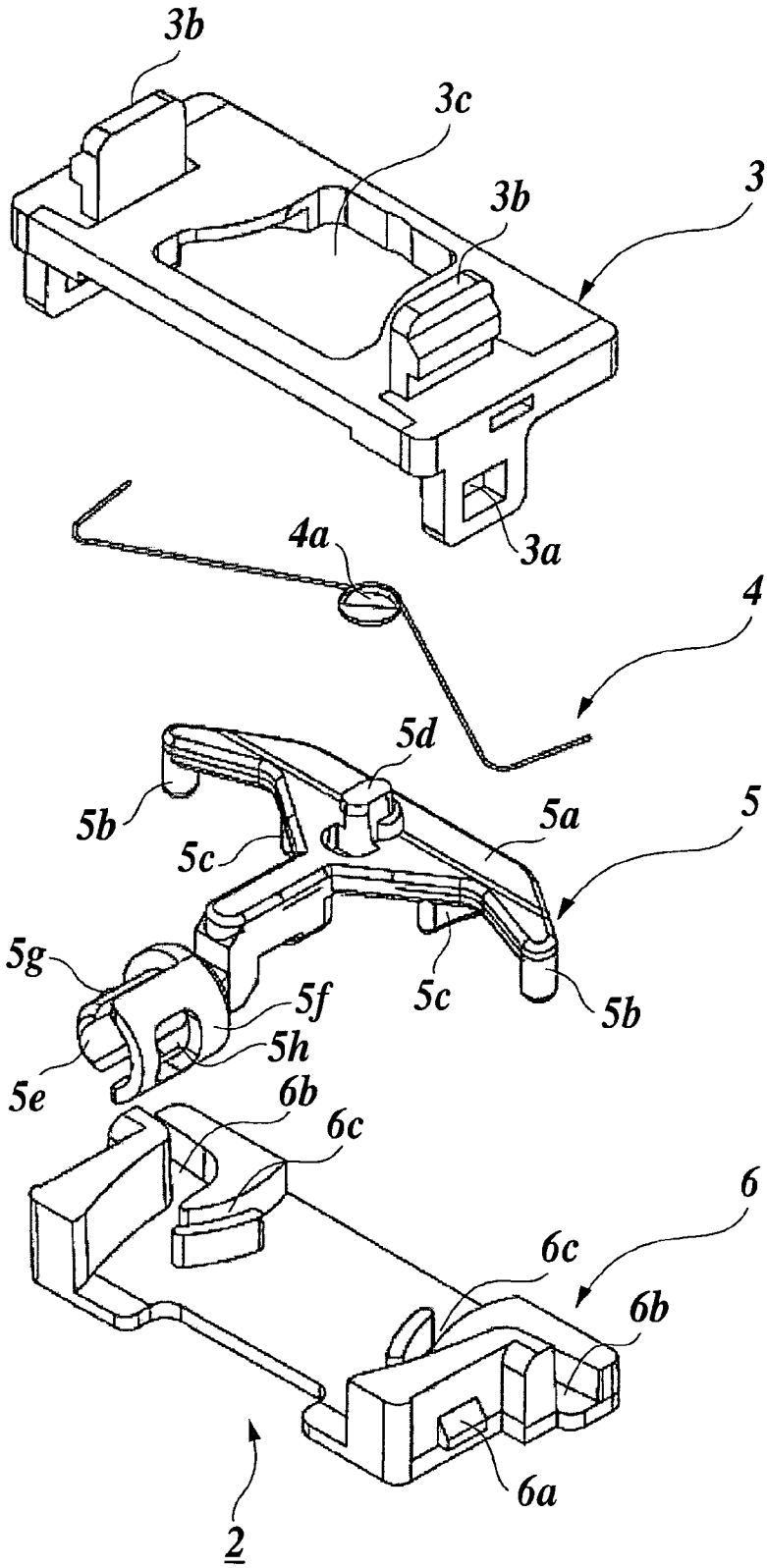
FIG. 2 is a developed perspective view of a coupler for a railway model.

FIG. 2 is a developed perspective view of the coupler 2 for a railway model. The coupler 2 comprises an upper coupler pocket 3, a coupler spring 4, a coupler body 5, and a lower coupler pocket 6. The coupler spring 4 is made of a metal wire rod bent to form a substantially M shape, and at its center, a substantially circular loop is made to form an attaching portion 4*a*. Other than the coupler spring 4, each of the elements 3, 5 and 6 is integrally formed of flexible plastic having elasticity. The upper and lower coupler pockets 3 and 6 are integrated by engagement of a pair of recessed portions 3*a* provided on the right and the left of the upper coupler pocket 3 (both sides of a vehicle) with a pair of projecting portions 6*a* provided on the right and the left of the lower coupler pocket 6. In the inner space formed by the integrated coupler pockets 3 and 6, the coupler body 5 which is swingable in right and left directions, and the coupler spring 4 are stored. The assembly consisting of these elements 3 to 6 is, as shown in FIG. 1, fixed to the railway model vehicle 1 by tightly fitting a pair of locking nails 3*b* provided on an upper portion of the upper coupler pocket 3 into a pair of locking hole la provided on the underfloor end portion of the railway model vehicle 1.

Figure 3:
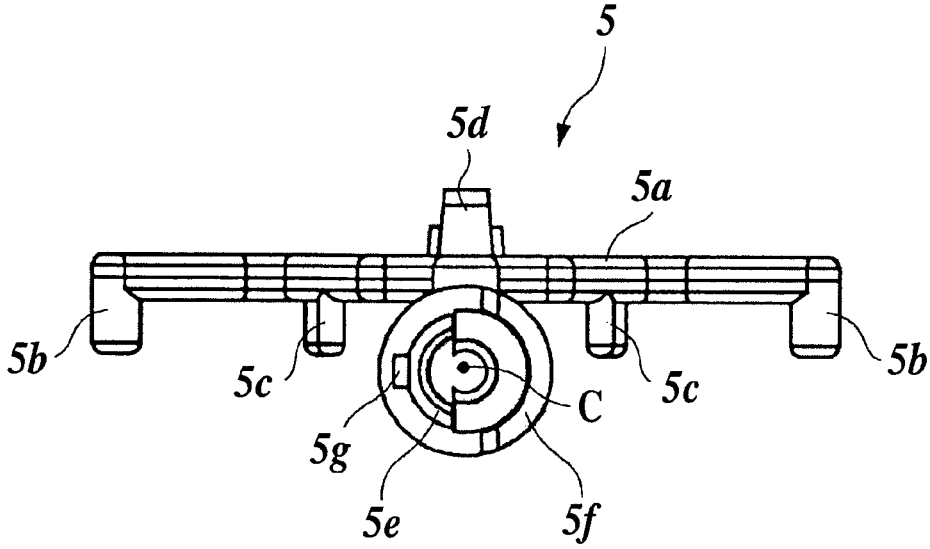
FIG. 3 is a front view of a coupler body of the first embodiment.
Figure 4:
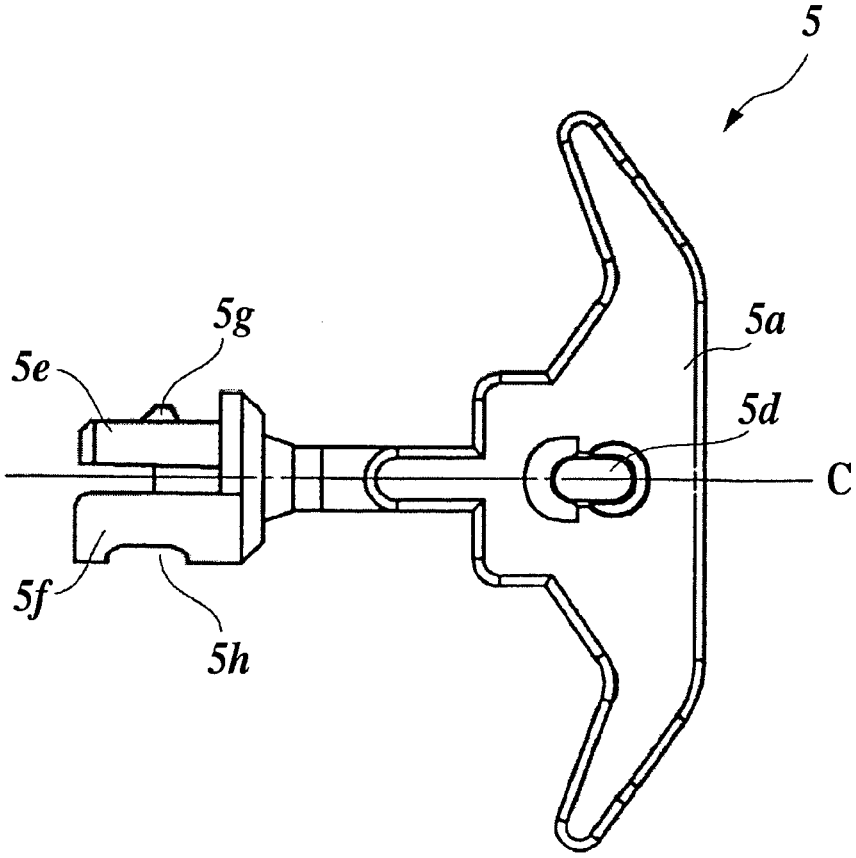
FIG. 4 is a top view of a coupler body of the first embodiment.
Figure 5:
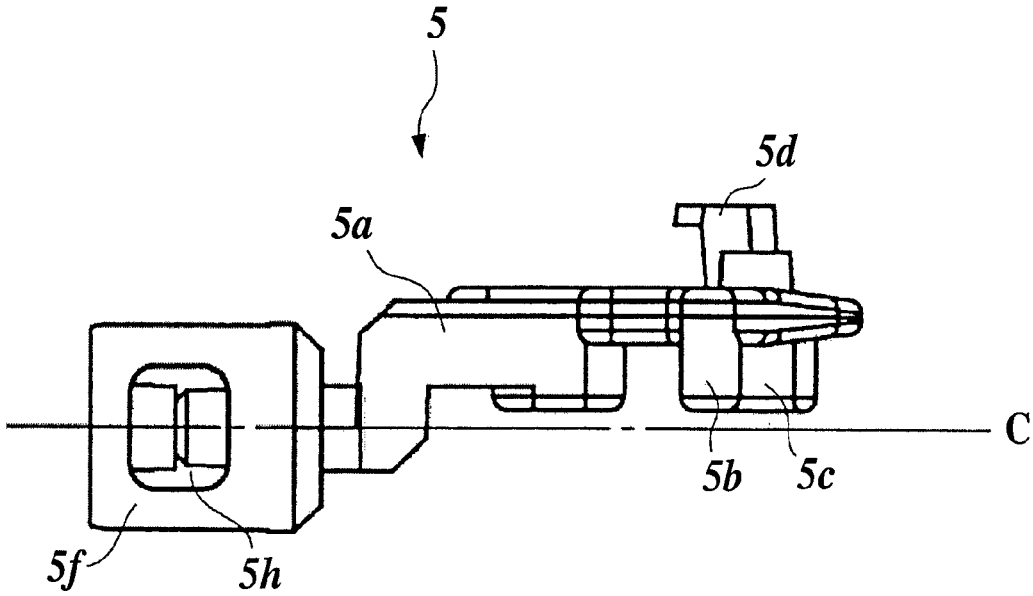
FIG. 5 is a right side view of a coupler body of the first embodiment.
Figure 6:
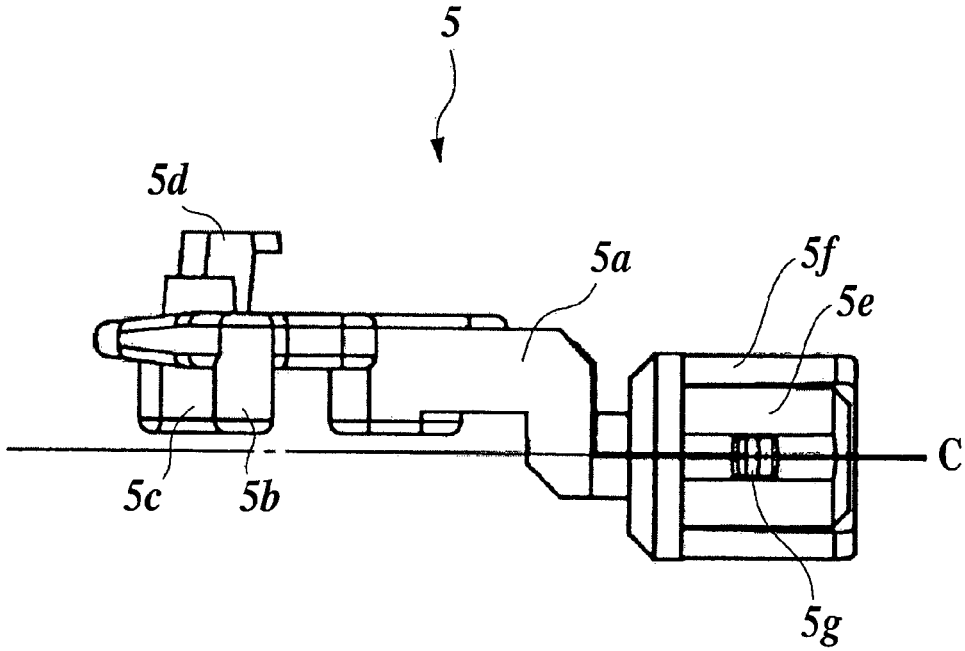
FIG. 6 is a left side view of a coupler body of the first embodiment

FIG. 3 is a front view of the coupler body 5 of the present embodiment, FIG. 4 is a top view, FIG. 5 is a right side view, and FIG. 6 is a left side view thereof. A base 5*a* of a substantially T shape is provided with a pair of first guide pins 5*d* having a substantially circular shape, projecting downward from both right and left ends thereof, and a pair of second guide pins 5*c* having a substantially arc shape, projecting downward from further inside of the first guide pins 5*d*. The right and left first guide pins 5*d* engage respectively with right and left first guide races 6*b* provided on the lower coupler pocket 6, and the movement thereof is restricted by the wall surface of second guide races 6*c*. A coupling shaft C which defines the direction of the coupler body 5 sways while, due the engagement of the guide pins 5*b*, 5*c* and the guide races 6*b*, 6*c*, sliding the supporting point of movement backward and forward and to the right and to the left. In other words, when the coupling shaft C turns from the middle front (neutral position) to the left, the supporting point changes position to the left front to accompany the position change of the coupling shaft C, and the coupling part which is made up of elements 5*e*and 5*f* projects to a position anterior to that when in the middle front. Consequently, when passing a left-hand curve inter-vehicle space is more widened than when running in a straight line, thereby avoiding the coupled vehicles coming into contact with each other. In the same manner, in a case the coupling shaft C turns to the right from the middle front, the supporting point changes position to the right front, and the coupling part projects to a position anterior to that when in the middle front, thereby preventing the coupled vehicles from coming into contact with each other while passing a right-hand curve. Meanwhile, on the center of a base 5*a*, a boss 5*d* is provided to project upward. The boss 5*d* is engaged with an attaching portion 4*a* of the coupler spring 4, and can freely change position thereof within a guide 3*c* provided substantially at the center of an upper coupler pocket 3. By the elasticity of the coupler spring 4, a biased force is applied on the coupler body 5 to return the coupler body to the neutral position. As the details of the swaying movement of the coupler body 5 and the necessary structure are disclosed in the Japanese Patent Publication No. 2580083 of the applicant which has already been patented, this may be referred to if necessary.

The coupling part provided at the end part of the base 5*a* (end part in the direction of the coupling shaft C) consists mainly of a first half cylindrical section 5*e* and a second half cylindrical section 5*f*. In FIG. 3, the first half cylindrical section 5*e* positioned in the left front side is an element of a substantially half cylindrical shape with the coupling shaft C as a central shaft, and on the outer peripheral surface thereof a first engagement section 5*g* is provided in a projecting manner. On the other hand, the second half cylindrical section 5*f* positioned on the front right side of FIG. 3 is, like the first half cylindrical section 5*e*, a substantially half cylindrical element with the coupling shaft C as a central shaft. The second half cylindrical section 5*f* is provided to face the first half cylindrical section 5*e*. These half cylindrical sections 5*e* and 5*f* are provided on a circle substantially concentric with the coupler shaft C as the center thereof, and have different size of diameters. More specifically, the inner diameter of the second half cylindrical section 5*f* is adopted to be greater than the outer diameter of the first half cylindrical section 5*e* because of the need to ensure binding clearance at coupling. On an inner peripheral surface of the second half cylindrical section 5*f*, a recessed second engagement section 5*h* is provided. The second engagement section 5*h* is provided at a position enabling engagement with a first engagement section 5*g* of a same type of a coupler 2 to be coupled with, specifically, at an axisymmetrical position against a perpendicular line (for example, along a same horizontal line). A recess width of the second engagement section 5*h* in the circumferential direction is adapted to be greater than a projecting width of the first engagement section 5*g* to allow a twist at coupling which will be explained later. In this embodiment the second engagement section 5*h* is described as a through hole penetrating the inner and outer surfaces of the second half cylindrical section 5*f*, but this penetration is not essential and a recessed race provided on the inner peripheral surface of the second half cylindrical section 5*f* would be also sufficient.

Figure 7:
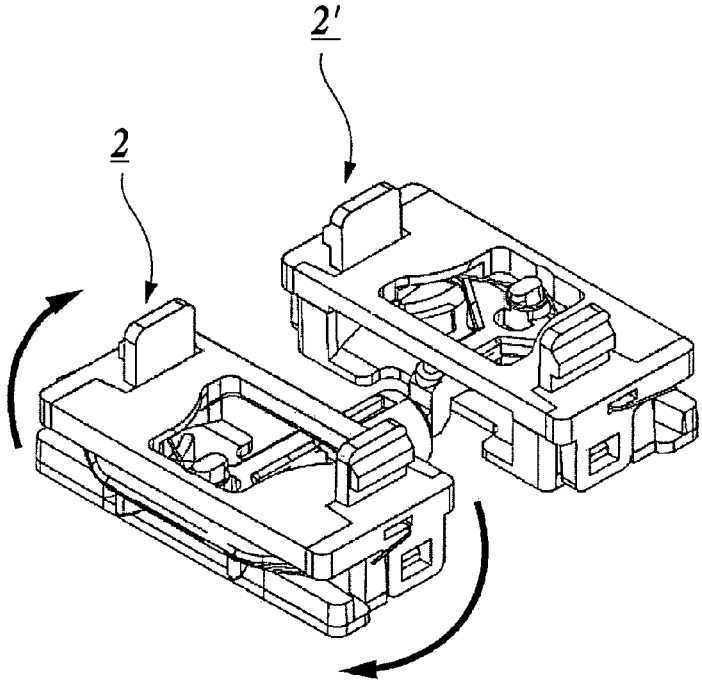
FIG. 7 is a view showing a coupling state of a pair of couplers for railway models of the first embodiment.

FIG. 7 shows a coupling state of a pair of couplers 2, 2' for a railway model of the present embodiment. In the explanation below, the coupler to be connected with is referenced as "2'", and each element consisting thereof is referenced with "'". The facing couplers 2, 2' are of the same above described structure which are coupled by the confronting coupling parts.

Figure 8:
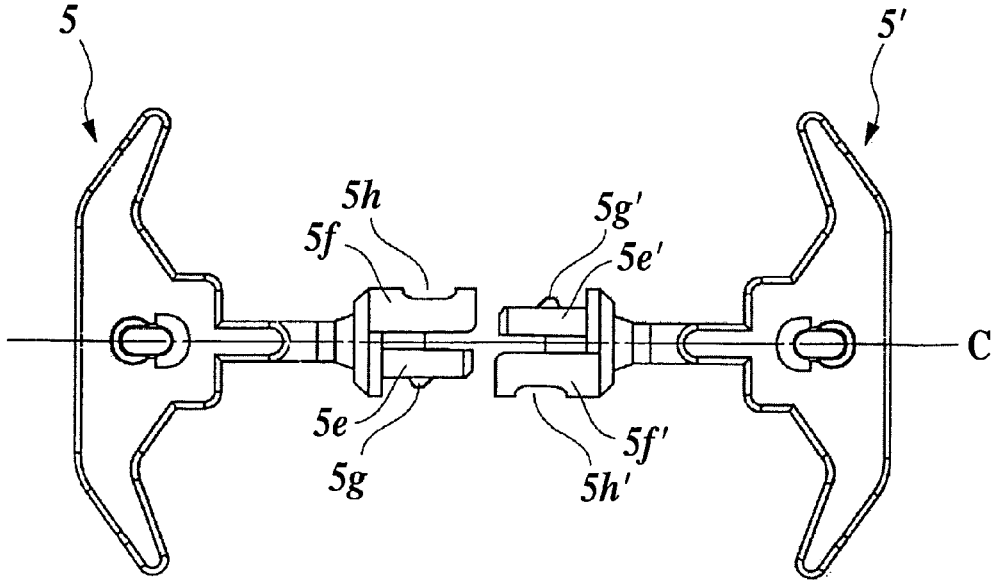
FIG. 8 is a view showing a facing state of a pair of coupler bodies of the first embodiment.

FIG. 8 shows a facing state of a pair of coupler bodies 5, 5'. In order to couple a pair of couplers 2, 2', initially the coupling shaft C of the coupler bodies 5, 5' is matched before. the coupling parts are put together. Thus, end portions of the first half cylindrical sections 5*e*, 5*e'* contact with end portions of the facing second half cylindrical sections 5*f'*, 5*f*, and are inserted therein. The second half cylindrical section 5*f'*, 5*f* are pushed on the inner periphery thereof by the first engagement sections 5*g*, 5*g'* to expand the diameters of the second half cylindrical sections 5*f'*, 5*f*, while the diameters of the first half cylindrical sections 5*e*, 5*e'* contract. Then, when the first engagement sections 5*g*, 5*g'* reach second engagement sections 5*h'*, 5*h* and the engagement of these sections take place, the diameters of the half cylindrical sections 5*f*, 5*f'*5*g*, 5*g'* resume the original sizes thereof. The engagement of the coupling parts is then complete.

Figure 9:
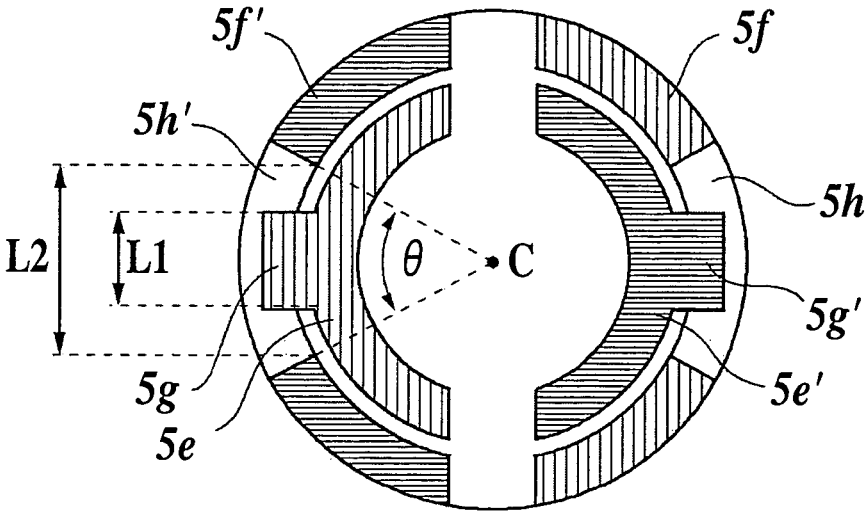
FIG. 9 is an explanation drawing of an engaged coupling section of the first embodiment.

FIG. 9 is an explanation drawing of engaged coupling sections of the first embodiment. A first engagement section 5*g* of one coupler body 5 is engaged with a second engagement section 5*h'* of the other coupler body 5'. Further, a first engagement section 5*g'* of the other coupler body 5' is engaged with a second engagement section 5*h* of the one coupler body 5. In a case the coupler 2 is twisted in a manner shown by the arrows in FIG. 7, the cylindrical sections 5*e*, 5*f* of the coupler body 5 rotate freely within the range of rotation amount θ. In other words, as long as it is within the range of rotation amount θ, the couplers 2, 2' allow a twist between vehicles to occur freely while retaining the coupling state. As described above, a recess length L2 in a circumferential direction of the second engagement section 5*h*, 5*h'* is adopted to be greater than a projection length L1 in a circumferential direction of the first engagement section 5*g*, 5*g'*. Therefore, the rotation amount θ is defined primarily by the relative size of the recess length L2. The greater the recess length L2, the greater the rotation amount θ, and the flexibility to a twist between vehicles improves.

Thus, according to the present embodiment, in a case a twist between vehicles occurs, the couplers 2, 2' flexibly trajectory track the twist. Therefore, even if one vehicle out of a coupled train falls, the couplers 2, 2' restrict a transmission of the twist between vehicles, thereby effectively preventing the whole train from falling. Moreover, according to the present embodiment, such a coupler 2 consists of a small number of parts and is of a simple structure, it is possible to keep its manufacturing cost low. This point is especially advantageous in manufacturing couplers 2 for N gauge, which is of a small scale. Further, according to the present invention, by imitating a bar-shaped coupler, the coupler 2 with a very real appearance is achieved.

Although the first and second half cylindrical sections 5*e*, 5*f* are adopted to be of a half cylindrical shape in this embodiment, they need not be strictly half cylinders having the rotation angle of 180°. As long as it is possible to maintain smooth rotation of the two elements when they are coupled, they may be of a polygonal shape such as a hexagon. The present specification broadly indicates these shapes by the term "having a substantially cylindrical shape".

Second Embodiment

Figure 10:
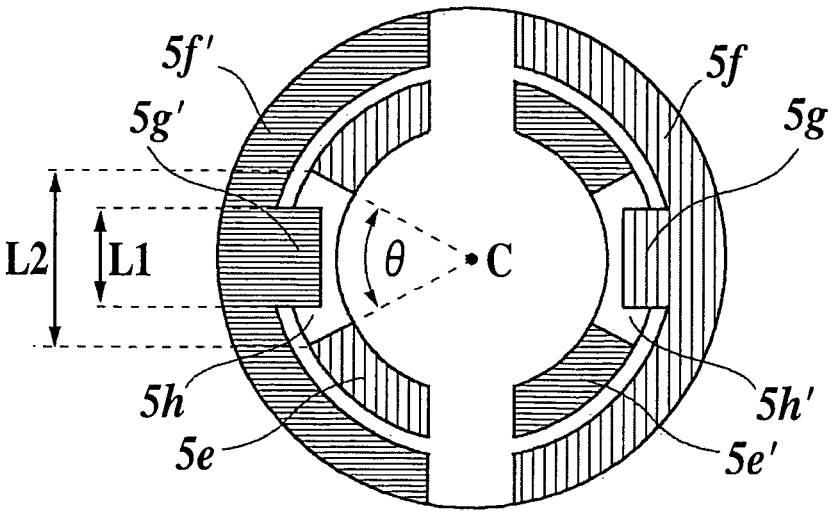
FIG. 10 is an explanation drawing of an engaged coupling section of the second embodiment.

FIG. 10 is an explanation drawing of engaged coupling parts of the second embodiment. The present embodiment is a modification of the first embodiment, and has the first engagement section 5*g* and the second engagement section 5*h* positioned in the opposite manner of the first embodiment. As the present embodiment is the same as the first embodiment other than this point, explanation is omitted here.

The first engagement section 5*g* is provided in a projecting manner in an inner peripheral surface of the second half cylindrical section 5*f* having a big diameter. The second engagement section 5*h* is provided in a recessed manner in an outer peripheral surface of the first half cylindrical section 5*e* having a small diameter at a position enabling engagement with a first engagement section 5*g*' of a same type of a coupler 2' to be coupled with. The first engagement section 5*g* of the one coupler body 5 engages with the second engagement section 5*h*' of the other coupler body 5'. The first engagement section 5*g*' of the other coupler body 5' engages with the second engagement section 5*h* of the coupler body 5. The recess width L2 in the circumferential direction of the second engagement section 5*h* is adopted to be greater than the projection width L1 in the circumferential direction of the first engagement section 5*g*.

According to the present embodiment, as with the first embodiment, it is possible to manufacture at a low cost a coupler 2 capable of flexibly trajectory tracking a twist between vehicles, and having a very real appearance.

Third Embodiment

Figure 11:
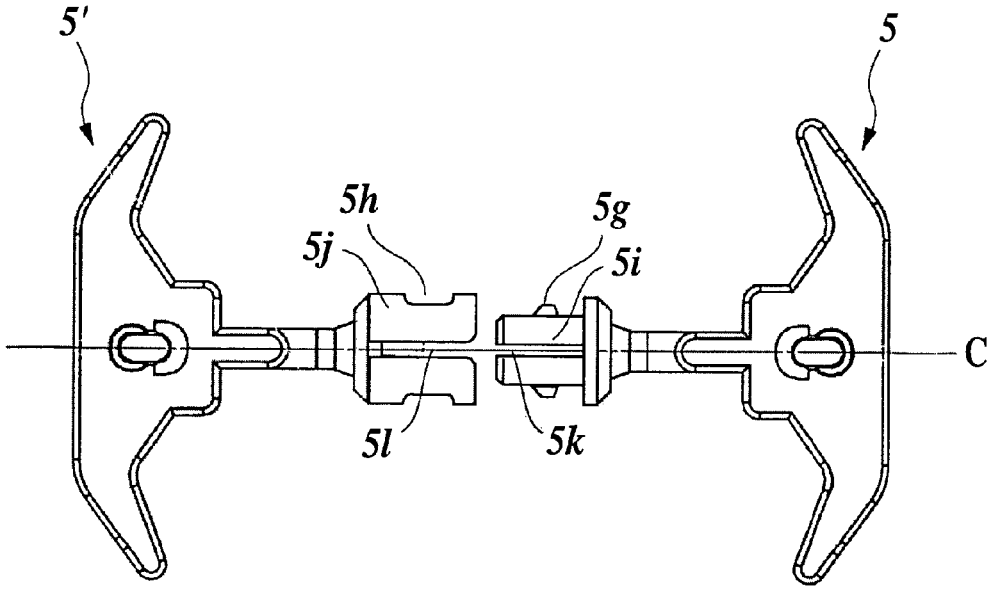
FIG. 11 is a view showing a facing state of a pair of coupler bodies of the third embodiment.

FIG. 11 is a view showing facing a state of a pair of coupler bodies 5, 5' of the third embodiment. While the above described first and second embodiments relate to the same type of couplers 2, 2', the present embodiment relates to different types of couplers 2, 2'. The couplers 2, 2' of the present embodiment differs from the first embodiment in the shapes of the coupling parts of the coupler bodies 5, 5', but are the same other than this point.

The coupling part of the one coupler body 5 comprises a first cylindrical section 5*i*, the first engagement section 5*g*, and a cut portion 5*k*. The first cylindrical section 5*i* is of a substantially cylindrical shape with a coupling shaft C as the center thereof. The outer diameter of the first cylindrical section 5*i* is adopted to be smaller than an inner diameter of a second cylindrical section 5*j*. The first engagement section 5*g* is provided in a projecting manner in an outer peripheral surface of the first cylindrical section 5*i* at a position enabling engagement with the second engagement section 5*h*. Further, the projection width in the circumferential direction of the first engagement section 5*g* is adopted to be smaller than the recess width in the circumferential direction of the second engagement section 5*h*. The cut portion 5*k* is disposed from the end portion of the first cylindrical section 5*i* towards the inside thereof. Because of this cut portion 5*k*, a diameter of the first cylindrical section 5*i* having the cut portion 5*k* is allowed to contract when the couplers 2, 2' are coupled.

The coupling section of the other coupler body 5' comprises the second cylindrical section 5*j*, the second engagement section 5*h*, and a cut portion 5*l*. The second cylindrical section 5*j* is of a substantially cylindrical shape with the coupling shaft C as the center thereof. An inner diameter of the second cylindrical section 5*j* is adopted to be greater than an outer diameter of the first cylindrical section 5*i*. The second engagement section 5*h* is provided in a recessed manner in an inner circumferential surface of the second cylindrical section 5*j* at a position enabling engagement with the first engagement section 5*g*. A recess width in the circumferential direction of the second engagement section 5*h* is adopted to be bigger than a projection width in the circumferential direction of the first engagement section 5*g*. The cut portion 5*l* is disposed from the end portion of the second cylindrical section 5*j* towards the inside thereof. Because of this cut portion 5*l*, a diameter of the first cylindrical section 5*j* having the cut portion 5*l* is allowed to contract when the couplers 2, 2' are coupled.

In order to couple different types of couplers 2, 2', initially, the coupling shaft C of the coupler bodies 5, 5' is matched before the coupling parts are put together. Thus, the end portion of the first cylindrical section 5*i* contacts with the end portion of the facing second cylindrical section 5*j*, and is inserted therein. Then, by the first engagement section 5*g*, the second cylindrical section 5*j* is pushed on the inner periphery thereof, to expand the diameter of the second cylindrical section 5*j* while the first cylindrical section 5*i* is pushed on the outer periphery thereof to contract the diameter of the first cylindrical section 5*i*. When the first engagement section 5*g* reaches the second engagement section 5*h* and become engaged therewith, the diameters of the cylindrical sections 5*i*, 5*j* resume the original size because of their elastic nature. The coupling of the coupling sections is thus complete.

In such a coupled state, the first engagement section 5*g* provided on the one coupler body 5 engages with the second engagement section 5*h* provided on the other coupler body 5'. Therefore, in the same manner as the mechanism shown in FIG. 7, as long as it is within the range of the rotation amount θ, the couplers 2, 2' freely allow a twist between vehicles, while maintaining the coupled state. As in the first embodiment, the recess length L2 in the circumferential direction of the second engagement section 5*h* is adopted to be greater than the projection length in the circumferential direction of the first engagement section 5*g*.

According to the present embodiment, although it is necessary to provide two types of coupler 2, 2', otherwise like the first embodiment, it is possible to manufacture at a low cost the couplers 2, 2' capable of flexibly trajectory tracking a twist between vehicles, and having a very real appearance.

Although the cut portions 5*k*, 5*l* are provided on both of the cylindrical sections 5*i*, 5*j* in the present embodiment, the cut portions 5*k*, 5*l* need not be provided on both cylindrical sections 5*i*, 5*j*. A cut portion on one of the cylindrical sections 5*i*, 5*j* is sufficient. This is also applicable to the forth embodiment which will be explained next.

Forth Embodiment

Figure 12:
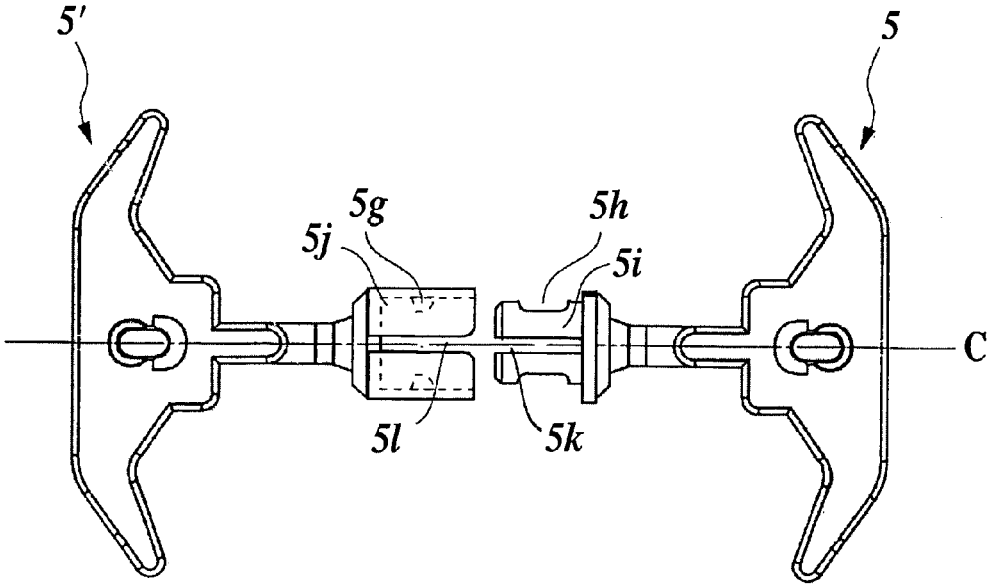
FIG. 12 is a view showing a facing state of a pair of coupler bodies of the fourth embodiment.

FIG. 12 is a view showing a facing state of a pair of coupler bodies 5, 5' of the fourth embodiment. The present embodiment is a modification of the third embodiment, and the first engagement section 5*g* and the second engagement section 5*h* are positioned in the opposite manner of the third embodiment. The present embodiment is otherwise the same as the third embodiment, and therefore explanations are omitted.

The first engagement section 5*g* is provided in a projecting manner on the inner peripheral surface of the second cylindrical section 5*j* having a large diameter. The second engagement section 5*h* is provided in a recess manner on the outer peripheral surface of the first cylindrical section 5*i* having a small diameter at a position enabling engagement with the first engagement section 5*g*. The first engagement section 5*g* of the one coupler body 5 engages with the second engagement section 5*h* of the other coupler body 5'. The recess width L2 in the circumferential direction of the second engagement section 5*h* is adopted to be greater than the projection width L1 in the circumferential direction of the first engagement section 5*g*.

According to the present embodiment, although it is necessary to provide two types of coupler 2, 2', like the third embodiment, it is possible to manufacture at a low cost couplers 2, 2' capable of flexibly trajectory tracking a twist between vehicles, and having a very real appearance.

INDUSTRIAL APPLICATION

Thus, the coupler for a railway model of the present invention is useful for railway model vehicles of various standards such as N gauge, HO gauge, and O gauge.

Explanation of Reference Numerals

1 railway model vehicle
1*a* locking hole
2 coupler (for railway model)
3 upper coupler pocket
3*a* recessed portion
3*b* locking nail
3*c* guide
4 coupler spring
4*a* attaching portion
5 coupler body
5*a* base
5*b* first guide pin
5*c* second guide pin
5*d* boss
5*e* first half cylindrical section
5*f* second half cylindrical section
5*g* first engagement section
5*h* second engagement section
5*i* first cylindrical section
5*j* second cylindrical section
5*k*, 5*l* cut portion
6 lower coupler pocket
6*a* projecting portion
6*b* first guide race
6*c* second guide race

The invention claimed is:

1. A coupler for a railway model comprising:

a first half cylindrical section having a substantially half cylindrical shape;

a second half cylindrical section having a substantially half cylindrical shape, facing the first half cylindrical section on a circle substantially concentric with the first half cylindrical section, and having an inner diameter greater than that of the first half cylindrical section;

a first engagement section provided in a projecting manner on an outer peripheral surface of the first half cylindrical section; and a second engagement section provided in a recessed manner on an inner peripheral surface of the second half cylindrical section, at a position enabling engagement with a first engagement section on a same type of a coupler to be coupled with, and having a recess width in a circumferential direction greater than a projection width in a circumferential direction of the first engagement section.

2. The coupler for a railway model as claimed in claim 1, wherein the second engagement section is a through hole penetrating inner and outer surfaces of the first half cylindrical section or the second half cylindrical section.

3. A railway model vehicle equipped at an end part of a vehicle with the coupler for a railway model as claimed in claim 1.

4. A coupler for a railway model comprising:

a first half cylindrical section having a substantially half cylindrical shape;

a second half cylindrical section, having a substantially half cylindrical shape, facing the first half cylindrical section on a circle substantially concentric with the first half cylindrical section, and having an inner diameter greater than that of the first half cylindrical section;

a first engagement section provided in a projecting manner on an inner peripheral surface of the second half cylindrical section; and a second engagement section provided in a recessed manner on an outer peripheral surface of the first half cylindrical section, at a position enabling engagement with the first engagement section on a same type of a coupler to be coupled with, and having a recess width in a circumferential direction greater than a projection width in a circumferential direction of the first engagement section.

5. The coupler for a railway model as claimed in claim 4, wherein the second engagement section is a through hole penetrating inner and outer surfaces of the first half cylindrical section or the second half cylindrical section.

6. A railway model vehicle equipped at an end part of a vehicle with the coupler for a railway model as claimed in claim 4.

7. A coupler for a railway model comprising:

a first cylinder having a substantially cylindrical shape; and a first engagement section provided in a projecting manner on an outer peripheral surface of the first cylindrical section, at a position enabling engagement with a second engagement section provided in a recessed manner on an inner peripheral surface of a second cylindrical section, having a substantially cylindrical shape, of a different type of a coupler for a railway model to be coupled with, wherein:

an outer diameter of the first cylindrical section is smaller than an inner diameter of the second cylindrical section; and a projection width in a circumferential direction of the first engagement section is smaller than a recess width in a circumferential direction of the second engagement section.

8. A coupler for a railway model comprising:

a second cylindrical section having a substantially cylindrical shape; and a second engagement section provided in a recessed manner on an inner peripheral surface of the second cylindrical section at a position enabling engagement with a first engagement section provided in a projecting manner on an outer peripheral surface of a first cylindrical section, having a substantially cylindrical shape, of a different type of a coupler for a railway model to be coupled with, wherein:

an inner diameter of the second cylindrical section is greater than an outer diameter of the first cylindrical section; and a recess width in a circumferential direction of the second engagement section is greater than a projection width in a circumferential direction of the first engagement section.

9. The coupler for a railway model as claimed in claim 8 wherein at least one of an end portion of the first cylindrical section and an end portion of the second cylindrical section has a cut portion extending inwards, to allow expansion or contraction of a diameter of a cylindrical section having the cut portion, when different types of couplers for railway models are coupled together.

10. The coupler for a railway model as claimed in claim 9 wherein the second engagement section is a through hole penetrating inner and outer surfaces of the first cylindrical section or the second cylindrical section.

11. A railway model vehicle equipped at an end part of a vehicle with the coupler for a railway model as claimed in claim 9.

12. The coupler for a railway model as claimed in claim 8 wherein the second engagement section is a through hole penetrating inner and outer surfaces of the first cylindrical section or the second cylindrical section.

13. The coupler for a railway model as claimed in claim 8 wherein at least one of an end portion of the first cylindrical section and an end portion of the second cylindrical section has a cut portion extending inwards, to allow expansion or contraction of a diameter of a cylindrical section having the cut portion, when different types of couplers for railway models are coupled together.

14. A railway model vehicle equipped at an end part of a vehicle with the coupler for a railway model as claimed in claim 8.

15. A coupler for a railway model comprising:

a first cylindrical section having a substantially cylindrical shape; and a first engagement section provided in a recessed manner on an outer peripheral surface of the first cylindrical section, at a position enabling engagement with a second engagement section provided in a projecting manner on an inner peripheral surface of a second cylindrical section, having a substantially cylindrical shape, of a different type of a coupler for a railway model to be coupled with, wherein:

an outer diameter of the first cylindrical section is smaller than an inner diameter of the second cylindrical section; and a recess width in a circumferential direction of the second engagement section is greater than a projection width in a circumferential direction of the first engagement section.

16. The coupler for a railway model as claimed in claim 15 wherein the second engagement section is a through hole penetrating inner and outer surfaces of the first cylindrical section or the second cylindrical section.

17. A railway model vehicle equipped at an end part of a vehicle with the coupler for a railway model as claimed in claim 15.

18. A coupler for a railway model comprising:

a second cylindrical section having a substantially cylindrical shape; and a second engagement section provided in a projecting manner on an inner peripheral surface of the second cylindrical section at a position enabling engagement with a first engagement section provided in a recessed manner on an outer peripheral surface of a first cylindrical section, having a substantially cylindrical shape, of a different type of a coupler for a railway model to be coupled with, wherein:

an inner diameter of the second cylindrical section is smaller than an outer diameter of the first cylindrical section; and a projection width in a circumferential direction of the second engagement section is smaller than a recess width in a circumferential direction of the first engagement section.

19. The coupler for a railway model as claimed in claim 18 wherein at least one of an end portion of the first cylindrical section and an end portion of the second cylindrical section has a cut portion extending inwards, to allow expansion or contraction of a diameter of a cylindrical section having the cut portion, when different types of couplers for railway models are coupled together.

20. The coupler for a railway model as claimed in claim 18 wherein the second engagement section is a through hole penetrating inner and outer surfaces of the first cylindrical section or the second cylindrical section.

21. A railway model vehicle equipped at an end part of a vehicle with the coupler for a railway model as claimed in claim 18.

* * * * *